United States Patent [19]

Thomas

[11] 3,942,667

[45] Mar. 9, 1976

[54] PACKAGE FOR BOTTLE AND CAP

[75] Inventor: Tedd Theodore Thomas, New Canaan, Conn.

[73] Assignee: Colgate-Palmolive Company, New York, N.Y.

[22] Filed: May 16, 1974

[21] Appl. No.: 470,453

[52] U.S. Cl. ..... 215/12 R; 217/6; 215/334

[51] Int. Cl.[2]B65D 23/08; B65D 41/62; B65D 51/18

[58] Field of Search ..... 206/521, 523, 229; 217/6; 215/13 R, 12 R, 1 R, 334; 220/17, 9 F

[56] References Cited

UNITED STATES PATENTS

| | | | |
|---|---|---|---|
| 2,078,743 | 4/1937 | Traum | 215/340 |
| 2,093,905 | 9/1937 | Bowen | 217/6 |
| 2,822,082 | 2/1958 | Breckwoldt et al. | 206/229 |
| 2,915,640 | 12/1959 | Grubel et al. | 220/17 |
| 3,120,319 | 2/1964 | Buddrus | 215/13 R |
| 3,249,248 | 5/1966 | Metzendorf et al. | 215/334 |
| 3,250,416 | 5/1966 | Clarke | 215/13 R |
| 3,631,650 | 1/1972 | Leftault, Jr. | 215/334 |
| 3,663,259 | 5/1972 | Barriere | 215/12 R |

*Primary Examiner*—William T. Dixson, Jr.
*Attorney, Agent, or Firm*—Kenneth A. Koch; Murray M. Grill; Herbert S. Sylvester

[57] ABSTRACT

A package for such liquids as men's cologne and after shave lotion comprising a cork covering for a bottle and cap in the form of two body members recessed for receiving the cap and bottle and so arranged as to facilitate the handling and opening and closing of the bottle and cap. The cork covering serves to protect against breakage while providing a particularly appealing outer configuration.

1 Claim, 5 Drawing Figures

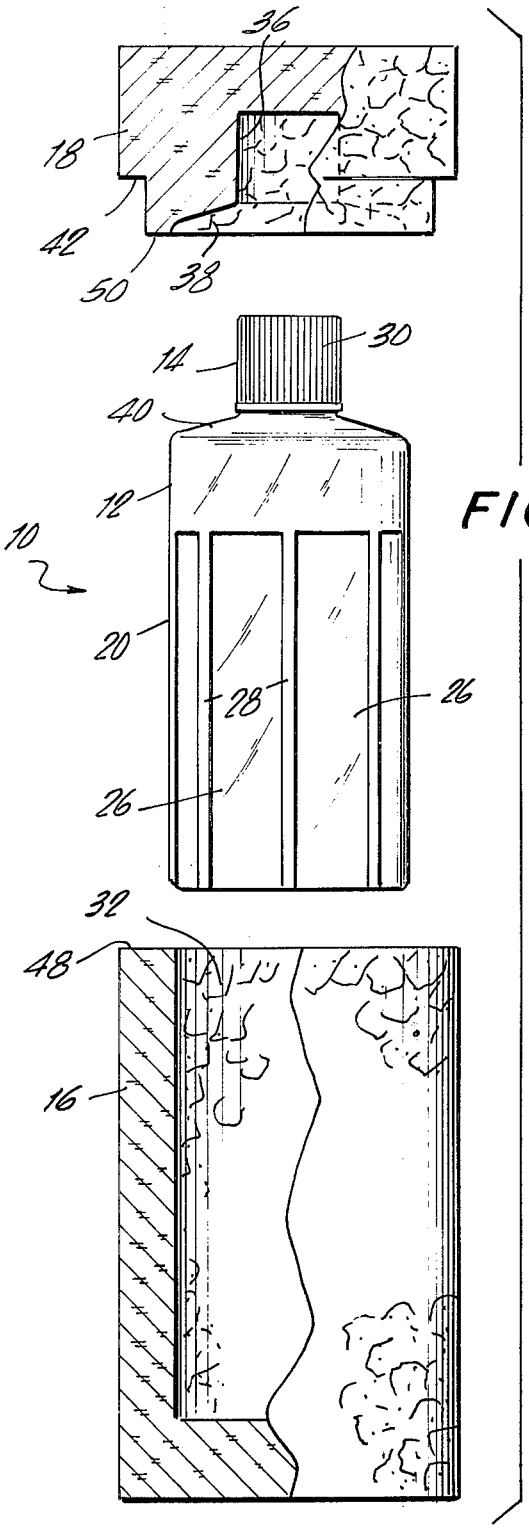
FIG. 1
FIG. 2
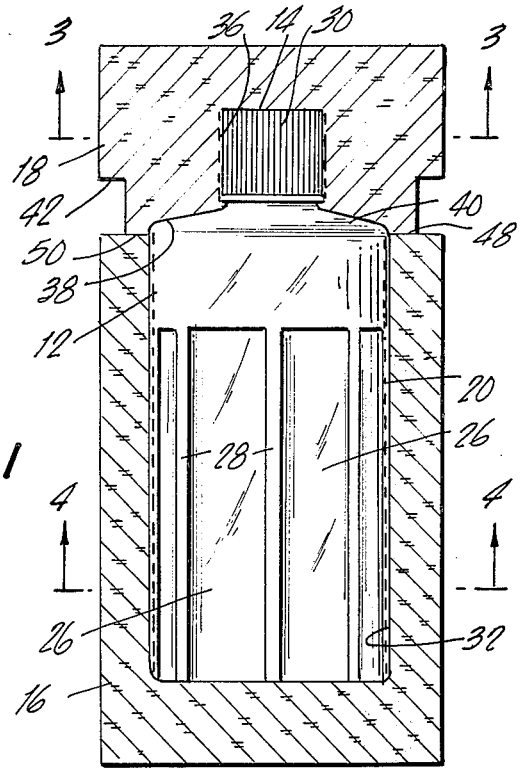
FIG. 3
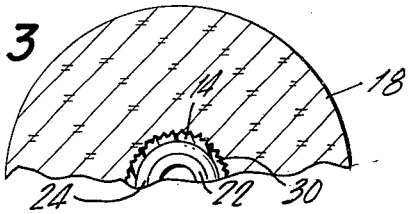
FIG. 4
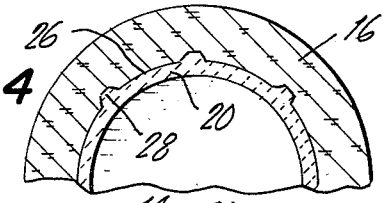
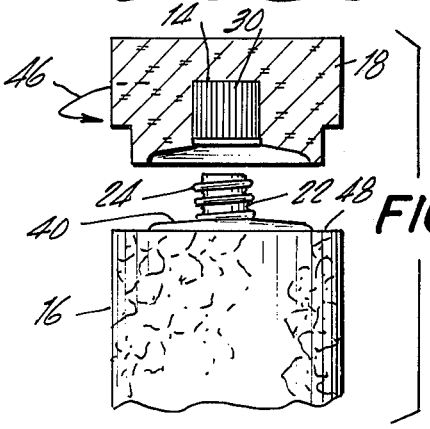
FIG. 5

PACKAGE FOR BOTTLE AND CAP

BACKGROUND OF THE INVENTION

1. Field of the Invention

This invention relates to a package especially adapted to men's cologne, after shave motion and the like type liquids, and more particularly to an arrangement for providing a highly ornamental and pleasing package while protecting the contents against breakage, while also facilitating the opening and closing of the bottle.

2. Description of the Prior Art

Various types of packages have been used for packaging men's colognes, after shave lotions, and like liquids. Significantly, the most widely used are glass bottles generally provided with plastic caps. Because of the nature of the goods stored in such containers, very often the cap, which must be screwed tight to prevent evaporation, is difficult to remove especially when the user's hands have become wet or soapy from other bathing or cleansing operations. Further, glass bottles are very breakable and wet or soapy hands often cause the dropping of the bottles and breakage thereof or the spilling of the contents. Hence, plastic bottles have been utilized, but have proven to be unsatisfactory due to the fact that certain plastics have crack sensitivity to various types of aromatic liquids and the plastic material has a generally cheap and unattractive appearance and in themselves are slippery.

SUMMARY OF THE INVENTION

The present invention overcomes the disadvantages of prior packaging by enabling the use of glass bottles and by providing for protection against breakage and for facilitating the opening and closing of the bottle while providing a highly attractive appearance.

The concept of this invention features a package employing two body members formed of cork which cover the bottle and cap and hold the bottle and cap against rotation thereby facilitating the handling, opening and closing of the bottle. The bottle and cap are provided with vertical ribs thereon which aid the cork body members to more firmly grip the respective bottle and cap.

It is therefore an object of the invention to provide a package for such liquids as men's cologne, after shave lotion, and the like that is highly ornamental in appearance, yet which facilitates the handling of the bottle and cap and protects the bottle against breakage, while also providing a generally slip and tip-free base for the container.

These, together with the various ancillary objects and features of the invention, which will become apparent as the following description proceeds, are attained by this package, a preferred embodiment of which is illustrated in the accompanying drawing, by way of example only, wherein:

BRIEF DESCRIPTION OF THE DRAWING

FIG. 1 is an exploded elevational view of the package with parts being broken away showing other parts in section;

FIG. 2 is a vertical sectional view of the package shown in a closed position;

FIG. 3 is a partial horizontal sectional view taken along the plane of line 3—3 in FIG. 2;

FIG. 4 is a partial horizontal sectional view taken along the plane of line 4—4 in FIG. 2; and, FIG. 5 is a partial vertical sectional view in a reduced scale showing the invention in use with the cap seated in a body member and removed from the bottle.

DETAILED DESCRIPTION OF THE PREFERRED EMBODIMENT

With continuing reference to the accompanying drawing, wherein like reference numerals designate similar parts throughout the various views, reference numeral 10 is used to generally designate a package constructed in accordance with the concepts of the present invention. The package 10 includes four main parts, namely, a bottle 12, a cap 14, a lower body member 16, and an upper body member 18.

The bottle 12 is preferably formed of glass and has substantially cylindrical side walls 20 and a neck 22 of reduced cross-sectional configuration. The neck is threaded as at 24.

The outerconfiguration of the cylindrical side wall 20 is such that a plurality of recessed panels 26 are formed defining a plurality of vertically extending ribs 28.

The cap 14 is internally threaded and its outer surface is fluted to form a plurality of ribs 30 which are closely spaced and which extend vertically.

The lower body member 16 is formed of cork which is suitably resilient and which is of a generally cylindrical shape having a cylindrical recess 32 therein. The recess 32 has a diameter which is slightly less than the diameter of the bottle 12. The bottle 12 is force fitted into the recess 32 so that it is resiliently held against rotation by the lower body member 16, the ribs 28 serving to aid against rotation, as can be seen best in FIG. 4. The upper body member 18 is provided with a recess 36 therein of slightly less diameter than the outer diameter of the cap 14, which is force fitted into the recess 36, with the ribs 30 serving to prevent relative rotation of the cap 14 and the upper body member 18. The upper body member 18 is provided with a further recess 38 for receiving the upper portion 40 of the bottle 12 and the upper body member is undercut at 42 to delineate the upper body member 18 from the lower body member 16.

In use, the bottle 12 is force fitted in the recess 32 with the cap 14 thereon. Then, the upper body member 18 is positioned so that the cap 14 is force fitted into recess 36. Rotation of the upper body member 18, such as indicated by arrow 46, FIG. 5, will rotate the cap 14 and thus facilitate the opening the closing of the bottle 12 by providing an easily grasped member having a much greater lever arm because of its greater diameter than that of the cap 14. Under conditions where a user's hands are wet or soapy, the manipulation of the bottle 12 and cap 14 is greatly facilitated by the body members 16 and 18 which have their respective upper surface 48 and lower surface 50 in abutting relationship, as can be seen in FIG. 2, when in a closed position. The use of the body members 16 and 18 will facilitate the tight closing of the bottle to prevent evaporation and the larger base of the lower body member 16 from that of the bottle 12 as well as the anti-slip surface provided by the cork construction thereof safeguards the bottle 12 against tipping or sliding as often occurs as when a glass bottle is placed on a wet or soapy sink or the like.

A latitude of modification, substitution and change is intended in the foregoing disclosure and in some instances some features of the invention may be employed without a corresponding use of other features.

What is claimed is:

1. A package for liquid comprising a bottle having substantially cylindrical side walls, a threaded reduced diameter neck and a conical shoulder connecting said sidewalls and said neck, a threaded cap having a roughened outer surface disposed on said neck, and a plurality of vertically extending ribs disposed on said cylindrical side walls, a first body member of a resilient cork material having a first recess therein of slightly less diameter than the diameter of said bottle across a pair of opposed ribs, said first recess having a depth of not more than the length of said side walls, said bottle being press fitted in said first recess so that said vertically extending ribs engage said resilient cork material, and a second body member of resilient cork material having a second recess therein said second recess including an upper portion of slightly less diameter than said cap and a lower portion conforming to said shoulder portion of said bottle, said cap being press fitted in said upper portion of said second recess so that the roughened outer surface of said cap engages said second body member and snugly grips said cap, and said lower portion of said second recess encloses said shoulder portion of said bottle, said first and second body members being in abutting relationship.

* * * * *